US005701551A

United States Patent [19]

Honda et al.

[11] Patent Number: 5,701,551

[45] Date of Patent: Dec. 23, 1997

[54] IMAGE FORMING APPARATUS INCLUDING CONTROL MEANS FOR CONTROLLING AN OUTPUT FROM EN ELECTRICAL POWER SOURCE TO A CHARGING MEMBER FOR CHARGING AN IMAGE BEARING MEMBER

[75] Inventors: Takao Honda, Yokohama; Makoto Yanagida, Kawasaki; Fumihiro Arahira, Ninomiyamachi; Takeo Yamamoto, Yokohama, all of Japan

[73] Assignee: Canon Kabushiki Kaisha, Tokyo, Japan

[21] Appl. No.: 749,829

[22] Filed: Nov. 15, 1996

Related U.S. Application Data

[63] Continuation of Ser. No. 518,221, Aug. 23, 1995, abandoned, which is a continuation of Ser. No. 377,680, Jan. 26, 1995, abandoned, which is a continuation of Ser. No. 91,186, Jul. 14, 1993, abandoned.

[30] Foreign Application Priority Data

Jul. 16, 1992 [JP] Japan ..... 4-189495

[51] Int. Cl.[6] ..... G03G 15/02

[52] U.S. Cl. ..... 399/50; 399/50

[58] Field of Search ..... 399/50, 174, 176; 361/221, 225, 230

[56] References Cited

U.S. PATENT DOCUMENTS

| | | | |
|---|---|---|---|
| 3,935,517 | 1/1976 | O'Brien | 317/262 |
| 4,851,960 | 7/1989 | Nakamura et al. | 361/225 |
| 5,072,258 | 12/1991 | Harada | 355/208 |
| 5,126,913 | 6/1992 | Araya et al. | 361/225 |
| 5,144,368 | 9/1992 | Ohzeki et al. | 355/219 |
| 5,159,388 | 10/1992 | Yoshiyama et al. | 355/208 |
| 5,160,967 | 11/1992 | Tonegawa | 355/208 |

FOREIGN PATENT DOCUMENTS

| | | |
|---|---|---|
| 0323226 | 7/1989 | European Pat. Off. . |
| 0404079 | 2/1990 | European Pat. Off. . |
| 58-90652 | 5/1983 | Japan . |
| 59-201075 | 11/1984 | Japan . |
| 61-053668 | 3/1986 | Japan . |
| 63-149668 | 6/1988 | Japan . |
| 64-73364 | 3/1989 | Japan . |
| 3-156476 | 7/1991 | Japan . |

OTHER PUBLICATIONS

McGraw–Hill Dictionary of Scientific and Technical Terms, Fourth Edition (1989), p. 330.

English Abstract of Japanese Laid–Open Patent Application No. 63–218972.

English Abstract of Japanese Laid–Open Patent Application No. 1–078364.

European Search Report.

European Examination Report dated Feb. 15, 1995.

*Primary Examiner*—William J. Royer

*Attorney, Agent, or Firm*—Fitzpatrick, Cella, Harper & Scinto

[57] ABSTRACT

An image forming apparatus includes a movable image bearing member; an image forming device for forming a toner image on the image bearing member; a charging member for charging the image bearing member in a charging station; and an electrical power source for supplying power to the charging member. A detector detects the voltage-current characteristic between the charging member and the image bearing member; and a controller controls the output of the electrical power source, in accordance with an output of the detector, when a surface area portion of the image bearing member, where the toner image is not going to be formed as the image bearing member rotates, is in the charging station.

26 Claims, 12 Drawing Sheets

IMAGE FORMING APPARATUS INCLUDING CONTROL MEANS FOR CONTROLLING AN OUTPUT FROM EN ELECTRICAL POWER SOURCE TO A CHARGING MEMBER FOR CHARGING AN IMAGE BEARING MEMBER

This application is a continuation of application No. 08/518,221 filed Aug. 23, 1995, now abandoned, which is a continuation of application No. 08/377,680 filed Jan. 26, 1995, abandoned, which is a continuation of application No. 08/091,186 filed Jul. 14, 1993, abandoned.

FIELD OF THE INVENTION AND RELATED ART

The present invention relates to an image forming apparatus such as an electrophotographic apparatus comprising a charging apparatus having a charging member for charging a surface to be charged, for example, the surface of a photosensitive member.

A corona discharging device has been widely used in image forming apparatuses such as an electrophotographic apparatus (copying machine, optical printer, or the like) or electrostatic recording apparatus, as a means or a device for charging an image bearing surface made of photosensitive material, dielectric material, or the like, that is, the surface to be charged.

The corona discharging device is effective as a means for uniformly charging the surface of the image bearing member or the like, that is, the surface to be charged. However, it has drawbacks in that it requires a high voltage power source, and also, that a relatively large amount of ozone is generated by the corona discharge.

On the other hand, in a contact charging device, the surface to be charged is charged when a charging member imparted with a voltage comes in contact with the surface to be charged. This offers advantages such that the power source voltage can be reduced; in that a relatively small amount of ozone is produced; or the like. Therefore, contact charging devices have been attracting attention as a charging means for charging the surface to be charged, that is, the image bearing surface made of the photosensitive material, dielectric material, or the like, and research has been conducted to make practical use of it.

For example, as had been proposed by this applicant (Japanese Laid-Open Patent Nos. 149,668/88, and 73364/89), if an oscillating electric field (alternating electric field) is generated, having a peak-to-peak voltage no less than twice the voltage, at which charging begins when a DC voltage is applied to the charging member in the contact charging device, and in addition, a charging member having a high resistance layer as the surface layer is employed, then the surface to be charged can be uniformly charged. Also, leaks caused by pin holes, damage, or the like in the photosensitive surface to be charged can be prevented.

Also, there are some other apparatuses in which the photosensitive member surface is charged to a predetermined potential by directly applying a potential to the photosensitive material surface, that is, the surface to be charged. More particularly, an electrically conductive material (potential holding conductive material) such as a conductive fiber brush or conductive elastic roller is placed, as the charging member, in contact with the surface to be charged, to apply, externally and directly, the DC voltage.

FIG. 14 is a schematic view of an example of a contact charging device.

A reference numeral 1 designates a member to be charged. In this example, it is an electrophotographic sensitive member of a rotating drum type. The photosensitive member 1 of this example comprises a base layer $1_b$ of conductive material such as aluminum or the like and a photoconductive layer $1_a$ formed over the base layer $1_b$.

A reference numeral 2 designates a charging member. In this example, it is of a roller type (hereinafter, referred to as charging roller). This charging roller comprises a central metallic core $2_c$, a conductive layer $2_b$, and a resistive layer $2_a$ covering the surface of the conductive layer $2_b$ and having a larger volume resistivity than the conductive layer.

The respective ends of the metallic core $2_c$ are supported by bearing members (not shown) in such a manner as to position the charging roller 2 parallel to the drum type photosensitive member while allowing the charging roller 2 to rotate, and at the same time, causing the a surface of charging member 2 to be pressed against the surface of the photosensitive member, with a predetermined pressure. With the above structure in place, the charging roller 2 is rotated by the rotation of the photosensitive member 1 as the latter is rotatively driven. It is also possible to attach a gear train or the like to the metallic core $2_c$ of the charging roller, so that the charging roller is directly driven by the driving force of a motor.

A reference numeral 3 designates a power source for imparting a bias to the charging roller 2. This power source 3 is electrically connected to the metallic core $2_c$ of the charging roller 2 so that a predetermined amount of bias is imparted to the charging roller 2 by the power source 3. As for the bias to be imparted, it has been proposed to impart a DC voltage or a DC biased alternating voltage.

As the photosensitive member 1, i.e., as the member to be charged, is rotated, the peripheral surface of the photosensitive member is charged to a predetermined polarity and potential, by the charging roller 2. That is, the charging member is pressed upon this photosensitive member 1 and is imparted with the bias voltage.

Generally speaking (details will be described later), after being charged, the charged surface is exposed according to an image, whereby an electrostatic latent image is formed thereon. The latent image is visualized or developed with the use of developing agents. Then, the visualized image is transferred onto a sheet of paper where it is fixed. After the image transfer, the surface of the photosensitive member 1 is cleaned by scraping off residual developer with the use of a cleaning blade. Then, it is exposed, so as to be cleared of the charge, and thereby initialized for the following image forming phase.

When images are formed as described above, the peripheral surface of the photosensitive member 1 is shaved off by the cleaning blade, developers, or the like, in proportion to the image formation count. As the thickness of the photosensitive layer of the photosensitive member is gradually reduced, its equivalent capacity changes, resulting in a charge characteristic change. In particular, in the case where a contact type system is used as the charging system to impart a DC current, the charge characteristic is greatly affected by the capacity change of the photosensitive member. As the image formation count increases, and therefore, the film thickness of the photosensitive layer is reduced, the direct current which flows through the charging roller increases. As a result, the surface potential of the peripheral surface of the photosensitive member increases.

If the surface potential of the photosensitive member increases due to the reduced film thickness of its photosensitive material, then the development contrast increases, which not only increases the image density, but also interferes with correspondence between the potential of the image forming area and the white portions of the target image. Therefore, a small amount of the developing agent is developed over the white area of the print, producing a "foggy" image.

Further, this surface potential increase occurs in the rotational direction of the photosensitive member, in other words, it occurs not only during the image forming phase but also during phases other than the image forming phase. Therefore, the drum surface potential also increases during the non-image forming phase, resulting in insufficient charge removal during the blank exposure phase (exposure for removing the charge from the image bearing surface in non-image forming phase), and also, resulting in a development contrast increase in the non-image area. Therefore, a small amount of the developer adheres across the drum surface area in the non-image forming phase, which normally is not used to transfer the developer onto a transfer material in this phase, causing drawbacks such as an excessive amount of developer consumption.

Further, when the drum surface area in the non-image forming phase is to be charged for a specific type of operation, the drum surface potential also increases as it does in the image forming phase, making it difficult to carry out a stable charging operation. During the non-transfer phase, in particular, when the transfer roller is in use, a cleaning bias control is executed, in which the developer adhering to the surface of the transfer roller is returned to the drum surface by means of imparting the transfer roller with a bias having a polarity opposite to the normal transfer voltage polarity, in other words, the same bias as the developer bias is imparted. Therefore, if the drum surface potential is not stable during the non-image forming phase, then the transfer roller cannot be effectively cleaned by the cleaning bias control. If the cleaning is not sufficient, then the toner left on the transfer roller adheres as a contaminant to the back side of the transfer material, which manifests itself as the problem of soiled transfer material after the completion of the image forming operation.

Even though the fogging and other problems can be corrected by adjusting the voltages for the developing bias, exposure lamp, or blank exposure lamp, such adjustments require the use of a large power source or a lamp with a large output to afford a sufficient adjustment range, thereby increasing the apparatus costs.

Further, with regards to a so-called AE of the conventional image forming apparatus which automatically selects an optimum condition, relative to the density of an original, for a development or latent image forming operation, when the surface potential of the photosensitive member changes, it becomes difficult to select the optimum image forming condition. Therefore, after the image formation count exceedes a specific number, the foggy image gradually appeared as the surface potential increases. In order to avoid this phenomenon, the image forming condition has to be manually adjusted while observing the image, or a surface potential sensor is needed for detecting the surface potential of the photosensitive member. As a result, the apparatus becomes larger and more complex, greatly increasing the costs, which is a major hindrance to the development of a small and inexpensive image forming apparatus.

Further, the resistance value of the resistive layer $2_a$ of the charging member 2 is easily affected by factors such as the ambient humidity or the extent of wear, thereby changing the surface potential of the photosensitive member changes, which becomes one of the factors counter to stable image density or image quality.

SUMMARY OF THE INVENTION

Accordingly, it is a principle object of the present invention to provide an image forming apparatus capable of preventing toner adhesion to the image bearing member surface in the non-image forming phase.

It is another object of the present invention to provide an image forming apparatus capable of preventing the surface potential change of the image bearing member which occurs as the image bearing member is gradually shaved away.

It is a further object of the present invention to provide an image forming apparatus capable of generating a stable electric field for transferring toner from the transferring means to the image bearing member.

These and other objects, features and advantages of the present invention will become more apparent upon consideration of the following description of the preferred embodiment, in conjunction with the accompanying drawings.

DETAILED DESCRIPTION OF THE PREFERRED EMBODIMENTS

Figure 1:
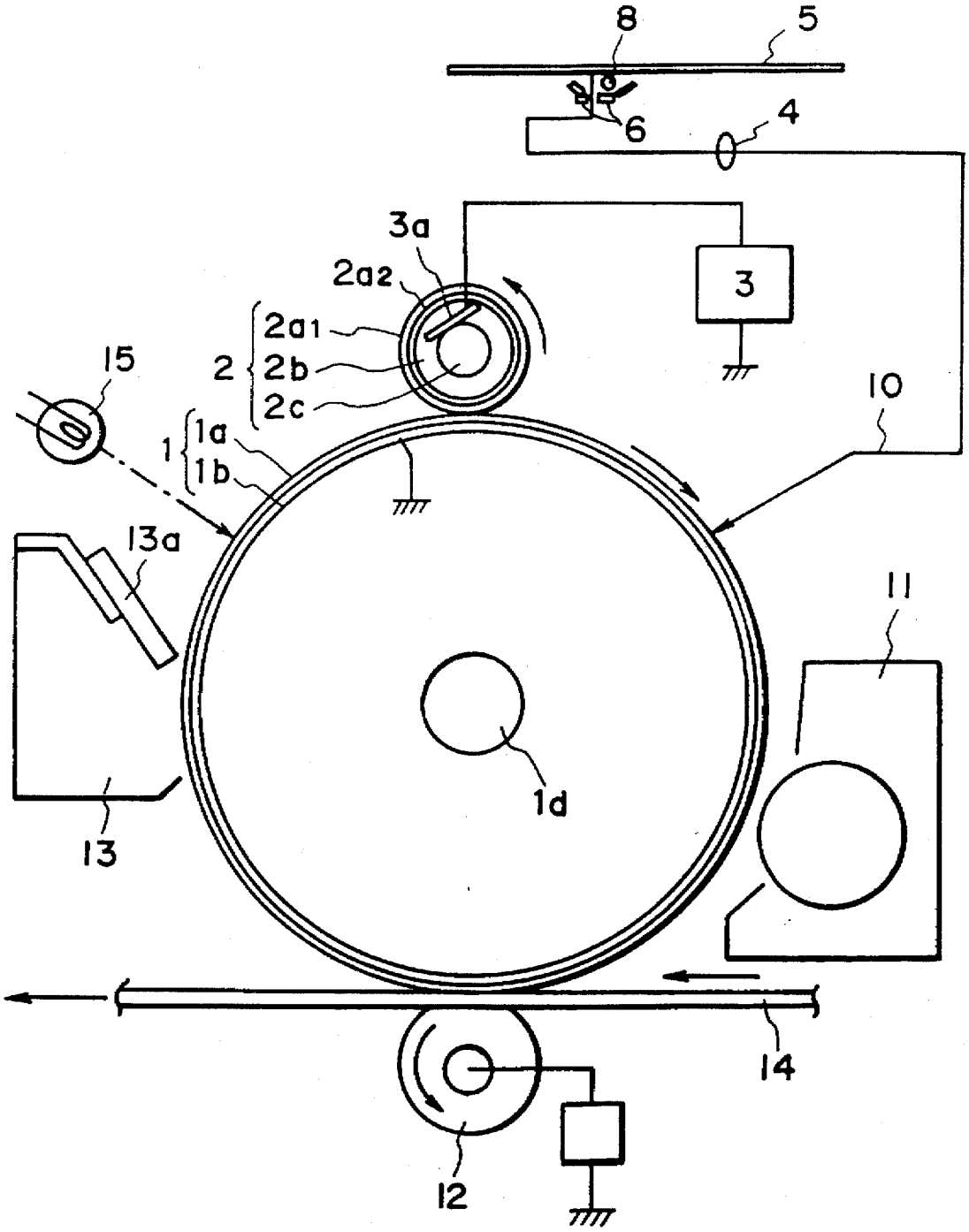
FIG. 1 is a schematic view of an image forming apparatus in accordance with the present invention.

FIG. 1 shows an essential structure of an image forming apparatus in accordance with the present invention.

A reference numeral 1 designates an image bearing member as the member to be charged, which, in this embodiment, is a drum type electrophotographic sensitive member comprising basically a base layer $1_b$ made of conductive material such as aluminum, being grounded, and a photoconductive layer $1_a$ formed on the surface of the base layer $1_b$. It is rotated about an axis $1_d$ in the clockwise direction of the drawing, at a predetermined peripheral velocity.

A reference numeral 2 designates a charging member disposed in contact with the surface of the photosensitive member for imparting to the photosensitive member surface a uniform primary charge having a predetermined polarity and potential. In this embodiment, it is a roller type charging member (hereinafter referred to as a charging roller). The charging roller 2 comprises a central metallic core $2_c$, a conductive layer $2_b$ formed on the peripheral surface of the metallic core $2_c$, and resistive layers $2_{a1}$ and $2_{a2}$ formed on the peripheral surface of the conductive layer $2_b$ and having a volume resistivity larger than that of the conductive layer $2_b$. The respective ends of the metallic core $2_c$ are supported by unshown bearing members in such a manner that the charging roller 2 is disposed in parallel to the drum type photosensitive member 1, and is also pressed upon the surface of the photosensitive member 1 by an unshown pressing means with a predetermined pressure, while allowing the charging member 1 to be rotated by following the rotation of the photosensitive member 1. With such an arrangement in place, the peripheral surface of the rotating photosensitive member 1 is contact-charged to a predetermined polarity (minus in this embodiment) and potential as a predetermined DC bias is applied to the metallic core $2_c$ by a power source 3.

The photosensitive member 1 surface charged uniformly by the charging member 2 is subjected to an exposure process such as exposure process by a scanning laser beam, a slit image of the original 5, or the like (in this embodiment, the exposure process is by a slit image of the original 5), in other words, it is exposed, by an exposing means 10 comprising a lamp 8, a slit 6, an unshown reflector mirror, and a focusing lens 4, to the light which is irradiated from a lamp 8, reflected by the surface of the original 5, carrying thereby image data of a target image, passed through a slit 6, and focused on the surface of the photosensitive member surface; whereby an electrostatic latent image corresponding to the image data of the target image is formed on the peripheral surface of the photosensitive member. Then, this latent image is serially visualized as a toner image (image composed of toner having a polarity opposite to the DC bias for charging, that is, a positive polarity in this embodiment) through a normal development process carried out by a developing means 11.

This toner image is serially transferred onto the surface of a transfer material 14 delivered, with a proper timing, from an unshown sheet feeding means to a transfer station located between the photosensitive member 1 and the transfer means, in synchronization with the rotation of the photosensitive member 1. In this embodiment, the transfer means 12 is a transfer roller, which charges, from behind, the transfer material 14 to a potential having a polarity opposite to the toner charge, whereby the toner image borne on the surface of the photosensitive member is transferred onto the top surface of the transfer material 14.

The transfer material 14 now carrying the transferred toner image is separated from the surface of the photosensitive member 1, is conveyed to an unshown image fixing means where the toner image is fixed, and then, is outputted as a copy. If it is necessary to form an image on the reverse side of the transfer material, then the transfer material is conveyed to a reconveying means for conveying the transfer material to the transfer station for the second time.

After the image is transferred, the surface of the photosensitive member 1 is cleared of adhering contaminants such as residual toner from the transfer operation, by a cleaning blade $13_a$ of a cleaning means 13, thereby becoming a clean surface, and then, is cleared of charge, by a charge removing exposure apparatus 15, to be repeatedly subjected to the image forming operation.

(2) Various types of the charging member 2

The roller type charging member 2 may be rotated by being in contact with the revolving surface of the rotating photosensitive member 1, (the member to be charged); it may be directly driven at a predetermined peripheral velocity in the direction in which the photosensitive member 1 is rotated, or in the opposite direction; or it may be a non-rotating type.

The charging member 2 may be shaped as a blade, block, rod, or belt, in addition to a roller.

Figure 2A:
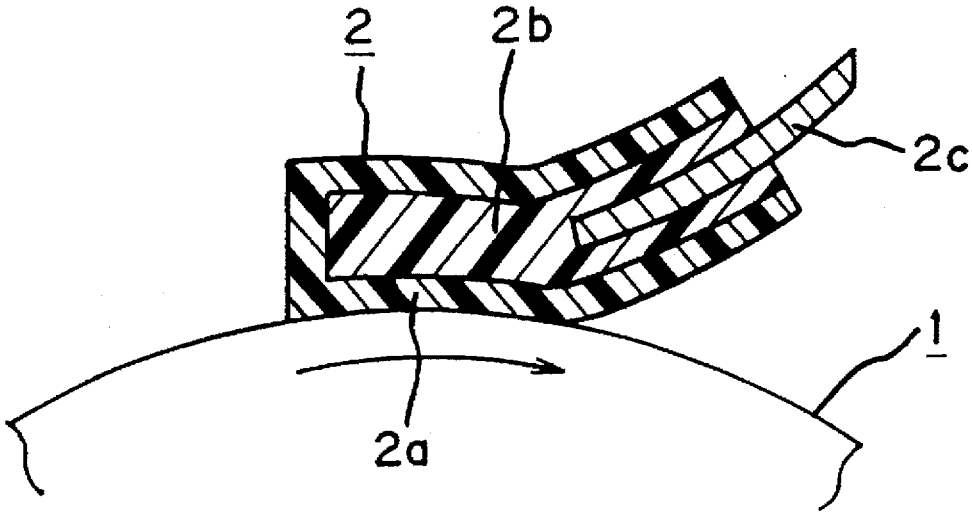
FIG. 2A is a schematic sectional view of a blade type contact charging member.
Figure 2B:
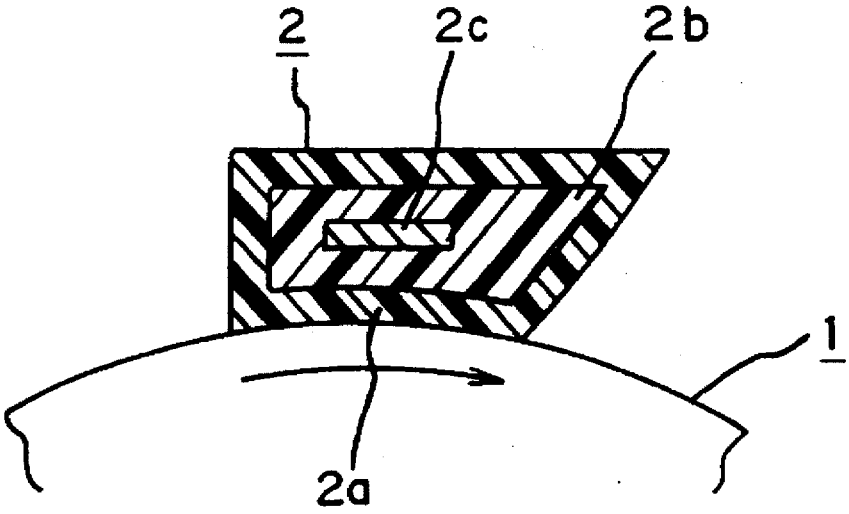
FIG. 2B is a schematic sectional view of a block or rod type contact charging member.

FIG. 2A is a sectional view of an example of the blade type charging member. In this case, the blade type charging member 2 may be oriented either in a direction the same as or opposite to the direction in which the surface of the member to be charged is revolving. FIG. 2B is a sectional view of an example of the rod type charging member. In each of two types of charging members 2, $2_c$ designates the conductive metallic core member to which a voltage is applied from the power source; $2_b$ the conductive layer; and $2_a$ designates the resistive layer.

As for the charging member of the block or rod type, a lead wire from the power source 3 can be directly connected to the metallic core member $2_c$, without a need for a sliding contact $3_a$ for supplying the power required in the roller type to apply the bias voltage to the metallic core member $2_c$, and therefore, it offers the advantage that electrical noises liable to be generated from the power supplying sliding contact $3_a$ can be eliminated, as well as other advantages in that it requires a smaller space for the charging member 2 and that it can double as the cleaning blade for the surface to be charged.

(3) Sequence

Figure 3:
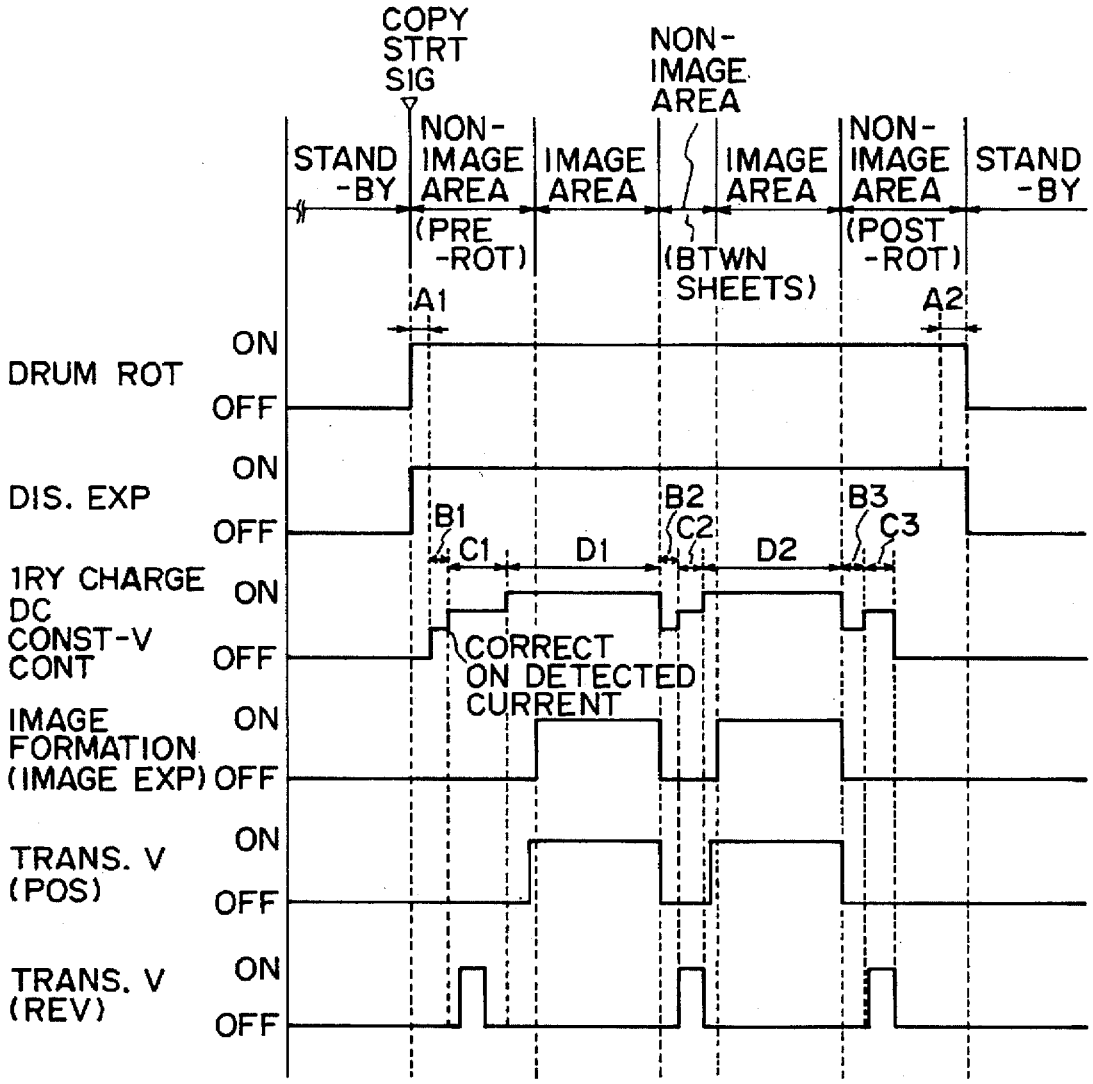
FIG. 3 is an operational sequence diagram for the image forming apparatus in accordance with the present invention.

FIG. 3 is an operational sequence diagram of the apparatus shown in FIG. 1. In this diagram, a case in which two sheets of transfer material are continually fed to produce two prints is shown. Also, in this sequence diagram, the time it takes for the drum surface to revolve from a charging station to an exposing station or to a transferring station is omitted, in other words, the same point on the abscissa does not indicate the same point in time, but indicates the same area on the drum surface.

(a) In response to a printing (copying) start signal, the photosensitive member 1 (hereinafter, referred to as a drum) of the apparatus being on standby begins to be rotated, entering the pre-rotation period. As soon as the rotation of this drum 1 begins, a charge removing exposure lamp 15 is turned on, entering a segment A1, to clear the drum 1 of the surface charge over the peripheral distance of more than one circumference.

(b) Next, the DC bias which is the primary charge bias to be applied to the charging member 2, that is, the contact charging member, is turned on.

(c) Entering a segment B1, this primary charging bias is at first controlled to hold a constant voltage, by a constant voltage control circuit connected to the charging roller, wherein the DC current is detected by a current detecting circuit, and corresponding to the detected DC current, the constant DC voltage value is calculated for the image forming phase, and also, for the non-image forming phase, with an additional correctional calculation based on the value for the former, to carry out the constant voltage control for the image forming operation. Entering a segment C1, the charging roller is first subjected to the constant DC voltage control for the non-image forming phase, in which the corresponding surface of the photosensitive member is charged for the non-image forming operation. In other words, the toner is not going to adhere to the corresponding area of the photosensitive member 1 surface by the developing apparatus as this portion of the drum surface area reaches the developing station as the drum rotates. When this area comes in contact with the transfer roller, the transfer roller is imparted with a cleaning bias having a potential opposite to the normal transfer polarity, to remove the contaminants on the roller. This cleaning bias is of the same polarity as the toner potential polarity, that is, positive. While this cleaning bias is applied, an electric field is generated for transferring the toner from the transfer roller to the drum.

(d) After the constant DC voltage control of the charging roller begins with use of the corrected primary voltage, the image forming operation for the first sheet of transfer material is started, whereby the drum surface is exposed to the light carrying the imaging data of the target image (slit exposure of the image on the original). At this time, the charging roller 2 is facing the image forming area of the drum 1 (area which becomes the area where the image is visualized in the developing station), and charges the surface of the drum 1 while being under the constant DC voltage control for the image forming phase (D1) in FIG. 3.

(e) During a period from when the image forming operation for the first print is completed to when the image forming operation for the second print is started, or a so-called inter-sheets period, the corresponding drum surface remains as the non-image forming area which is not developed by the toner when it revolves into the developing station. In this embodiment, the charging roller 2 is subjected to the process of the constant DC voltage control, DC current detection, and constant DC voltage control, even during this inter-sheets period.

In other words, after completion of the first print, the primary charging bias is again constant DC voltage controlled in a segment B2 during the inter-sheets period; the DC current is detected; and in accordance with the detected current, the primary bias is constant DC voltage controlled to impart the transfer roller cleaning bias to the non-image forming area (C2), and then, the image forming bias to the image forming area (D2), to begin the image forming operation for the second print.

Also, when three or more prints are to be continuously made, the same sequence of the constant DC voltage control, DC current detection, and constant DC voltage control is carried out between the sheets.

(f) After the image forming operation for the last print is completed, the drum 1 enters a post-rotation period, where the constant DC voltage control (B3), DC voltage detection, and constant voltage control (C3) for the non-image forming phase are carried out. Also, in a segment A2 of this post-rotation period, the drum 1 is rotated for a peripheral distance of more than one circumference so that its surface is cleared of charge by exposing it to the charge removing light 15, and then, rotation of the drum 1 is stopped and the charging removing light is turned off, at which time the apparatus enters a standby period in which the apparatus remains on standby until the next print start signal is inputted.

If an image forming apparatus having such a structure as described above is used for a long time, the drum surface is shaved away and the film thickness of the photosensitive material becomes thin. This increases the DC current detected during the constant DC voltage control segments B1 or B2 when the charging roller 2 is facing the then non-image forming area of the drum 1 (area where no image is visualized in the developing station), compared to when the drum 1 is new, and as a result, the image forming area of the drum 1 is charged for the image forming phase, by the charging roller imparted now with a corrected voltage, that is, a voltage lowered in response to the above mentioned increase in the detected DC current.

Also, in a low humidity environment, the resistance of the charging roller 2 increases, and as a result, the DC current detected during the aforementioned period B1 or B2 under the constant voltage control becomes smaller. Then, the surface of the drum 1 is charged for the image forming operation, by the charging roller imparted now with the corrected voltage, that is, a voltage increased in response to the above mentioned decrease in the detected DC current. Therefore, the charge potential of the drum 1 remains stable regardless of the environment related resistance change of the charging roller.

(4) Method for correcting the voltage

Next, a method is described for using a DC power source 3 to obtain an optimum charge.

First, a charging mechanism is described regarding a case in which a DC voltage is applied to the charging roller 2 using the DC power source 3. In this case, a photosensitive drum having an organic photoconductive layer displaying negative polarity was employed as the photosensitive member 1. More particularly, azo pigment was employed in a CGL layer (carrier generating layer), and then, on this CGL layer, a CTL layer (carrier transfer layer) composed of a mixture of hydrazone and resin was laminated to a thickness of 15 μm, 19 μm, 24 μm, or 29 μm, making four drums having the organic semiconductor layer (OPC layer) displaying negative polarity.

Each of these OPC photosensitive drums was charged, as it was rotated in a dark place, by the charging roller 2 placed in contact with the drum surface and imparted with a DC voltage. Then, after the drum passed the location of the charger, a surface potential $V_D$ of the OPC photosensitive drum was measured with reference to a DC voltage $V_{DC}$ applied to the charging roller 2, to study their relation.

Figure 7A:
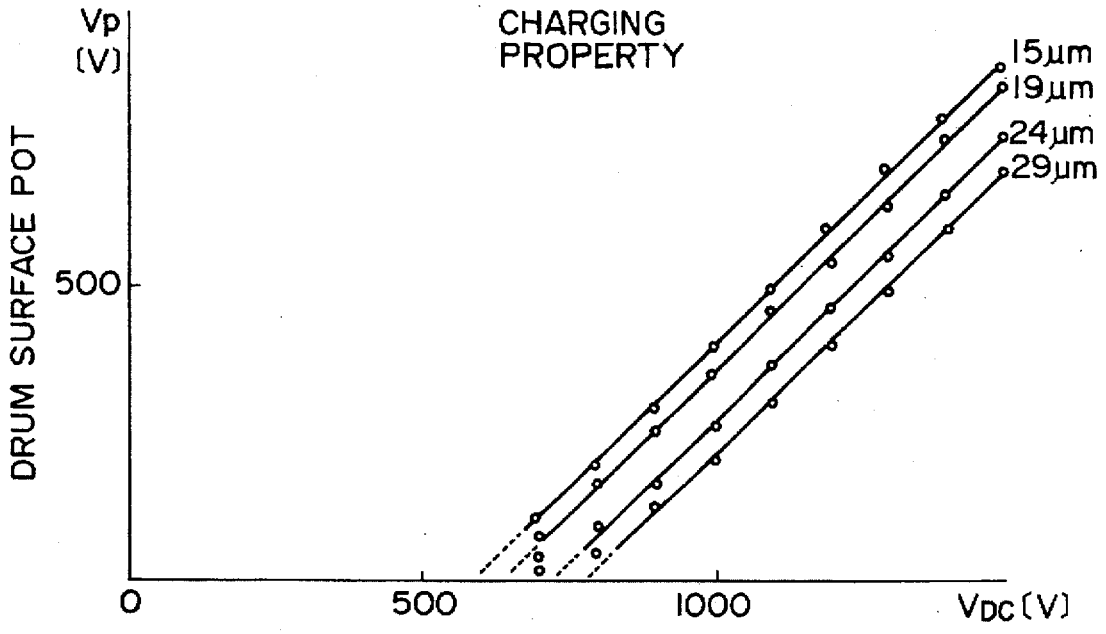
FIGS. 7A and 7B are graphs of the drum surface potential and detected current, respectively, with reference to the applied voltage.

In FIG. 7A, straight lines in the graph represent the results of the measurements. With reference to the applied DC voltage $V_{DC}$, each drum began to be charged at a particular voltage, in other words, a different threshold was present for each drum film thickness. Above the threshold voltage, a linear relation, showing an inclination of I in the graph, was observed between the applied voltage having an absolute value larger than the charge starting voltage, and the obtained surface potential $V_D$, Here, the charge starting voltage was defined as follows. First, only a DC voltage was applied to the charging member placed in contact with an image bearing member having zero potential, wherein the DC voltage was gradually increased. The graph was made by plotting the surface potential of the photosensitive member, which was the image bearing member, obtained in accordance with the increase in the applied DC voltage. At this time, the DC voltage was incremented by 100 V from the first DC voltage point at which the surface potential appears for the first time, and corresponding DC potentials were measured with reference to ten DC voltage points. Then, the values of these ten measurements were processed using the least square approximation method of statistics to draw a straight line. Then, the value of the applied DC voltage at the intersection between this line and the applied DC voltage scale, in other words, where the surface potential was zero on this line, was defined as the charge starting voltage. The straight line in the graph in FIG. 7 was obtained by the above described least square approximation method.

In other words, the following relation exists between the surface potential $V_D$ which appeared on the OPC photosensitive drum surface when the DC voltage $V_{DC}$ was applied to the charging roller 2, and the charge starting voltage $V_{TH}$.

$$V_D=V_{DC}-V_{TH}$$

The above equation was derived using Paschen's law.

Figure 4:
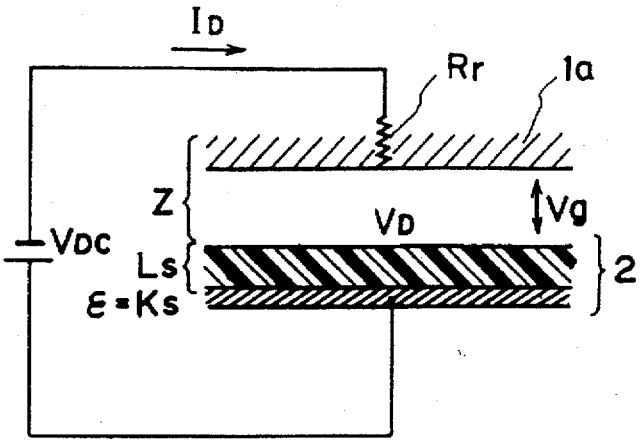
FIG. 4 is a drawing for describing the principle of charging.

FIG. 4 shows the charging roller 2, POC photosensitive layer, and an equivalent circuit formed in a micro-gap Z between the two. When an overall resistance Rr of the charging roller 2 is small, a voltage drop ($I_DR_r$) caused by a current ID flowing through the photosensitive layer 1 is sufficiently small so as to be ignored, compared to the $V_{DC}$. Ignoring Rr, a voltage $V_g$ across the gap Z is expressed by the following Equation (1).

$$V_g=V_{DC}\cdot Z/(L_S/K_S+Z) \quad (1)$$

$V_{DC}$: voltage applied to the charging member

Z: gap between the charging member and photosensitive member $L_S$: thickness of the photosensitive layer $K_S$: specific dielectric constant On the other hand, as for the discharging phenomenon in the gap Z, when Z≧8 μ, breakdown voltage $V_b$ can be approximated by the following Equation (2) and (2)'.

$$V_b=312+6.2Z(V_b>0) \quad (2)$$

$$V_b=-(312+6.2Z)(V_b<0) \quad (2)'$$

Figure 5:
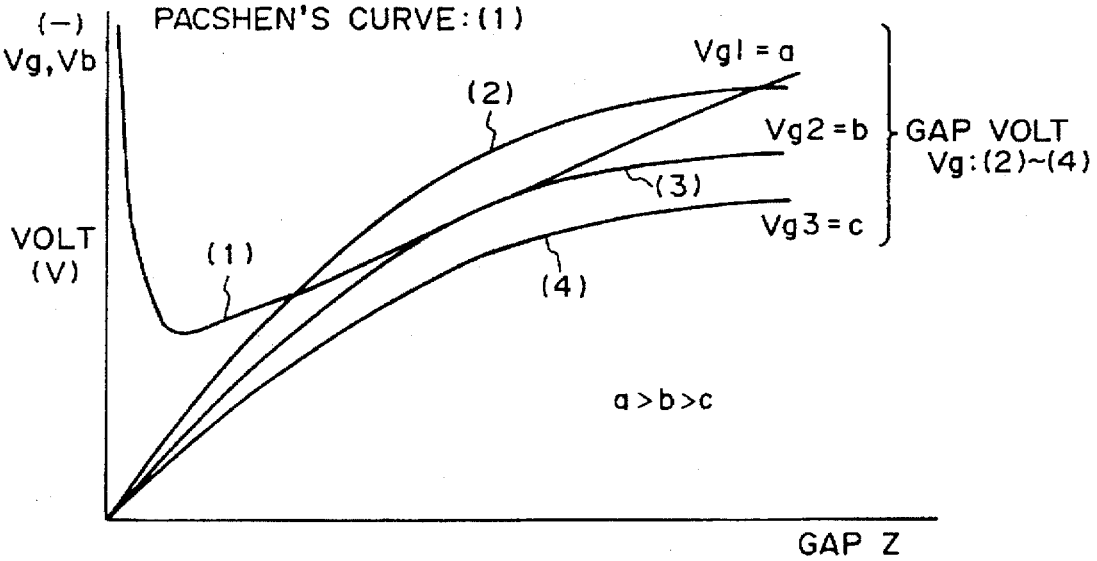
FIG. 5 is a graph of Paschen's curve.

Since $V_b<0$, Equations (1) and (2)' can be graphed as shown in FIG. 5. The abscissa represents the width of the gap Z, and the ordinate represents the breakdown voltage. The curve (1) with a dip is the Paschen's curve, and the other curves (2), (3), and (4) show the characteristics of the breakdown voltage $V_g$ with reference to respective values of Z.

The discharge begins to occur at points when the Paschen's curve intersects with the curves (2), (3), or (4), and at points where the discharge begins, the discriminant of the quadratic equation of Z obtained by assuming $V_g=V_b$ becomes zero. These points are the discharge threshold point, and therefore, $V_{DC}=V_{TH}$.

Since ozone generation is also acknowledged during the charging process using the above described charging roller 2, in the immediate proximity of the charging station, though the amount is minute ($10^{-2}$–$10^{-3}$ compared to the corona discharge), it seems reasonable to think that the charging by the charging roller is related to the discharging phenomenon, and therefore, the Paschen's law which concerns the discharge phenomenon across a gap is also applicable in this case. Therefore, in order to control $V_D$ by $V_{DC}$, the following Equation (3) is employed.

$$V_{DC}=V_R+V_{TH} \quad (3)$$

$V_R$: target surface potential

Here, $V_{TH}$ for a selected target potential value is obtained by Equation (3) and then, with the addition of $V_{TH}$, $V_D$ can be made to approach $V_R$. As is evident from Equation (3), the threshold voltage $V_{TH}$ is determined by an equation, $D=L_S/K_S$. At this time, the specific dielectric constant $K_S$ of the photosensitive layer is affected by the ambient temperature, humidity, or the like of the photosensitive member, and also, the thickness $L_S$ of the photosensitive layer is reduced through use. Therefore, the surface potential $V_D$ changes as the threshold voltage value $V_{TH}$ changes due to the ambient conditions or the length of usage. In other words, by knowing the values of $K_S$ and $L_S$, the DC voltage value $V_{DC}$ for obtaining the optimum surface potential $V_D$ can be determined.

Figure 6A:
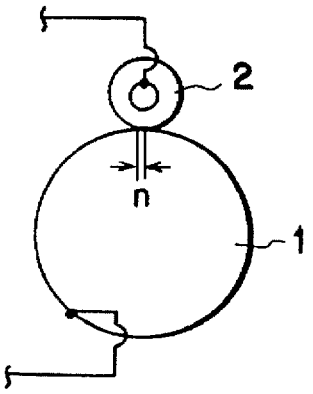
FIG. 6A is a schematic drawing for describing the principle of charging.
Figure 6B:
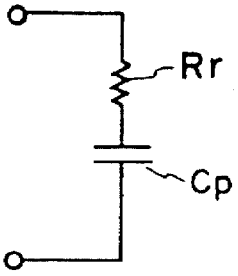
FIG. 6B is an equivalent circuit.

Here, a capacitance $C_p$ between the photosensitive drum 1 and charging roller 2 is formed in a nip n which is the contact surface between the two components. Referring to an equivalent circuit shown in FIG. 6B, $C_p$ has the following relation, wherein $S_p$ is the size of the contact surface in the nip.

$$C_p=(S_p\times K_S)/L_S=S_p/D$$

In other words, $C_p\propto 1/D$, and therefore, the proper DC voltage $V_{DC}$ can be obtained from Equation (3) by knowing $C_p$.

Figure 7B:
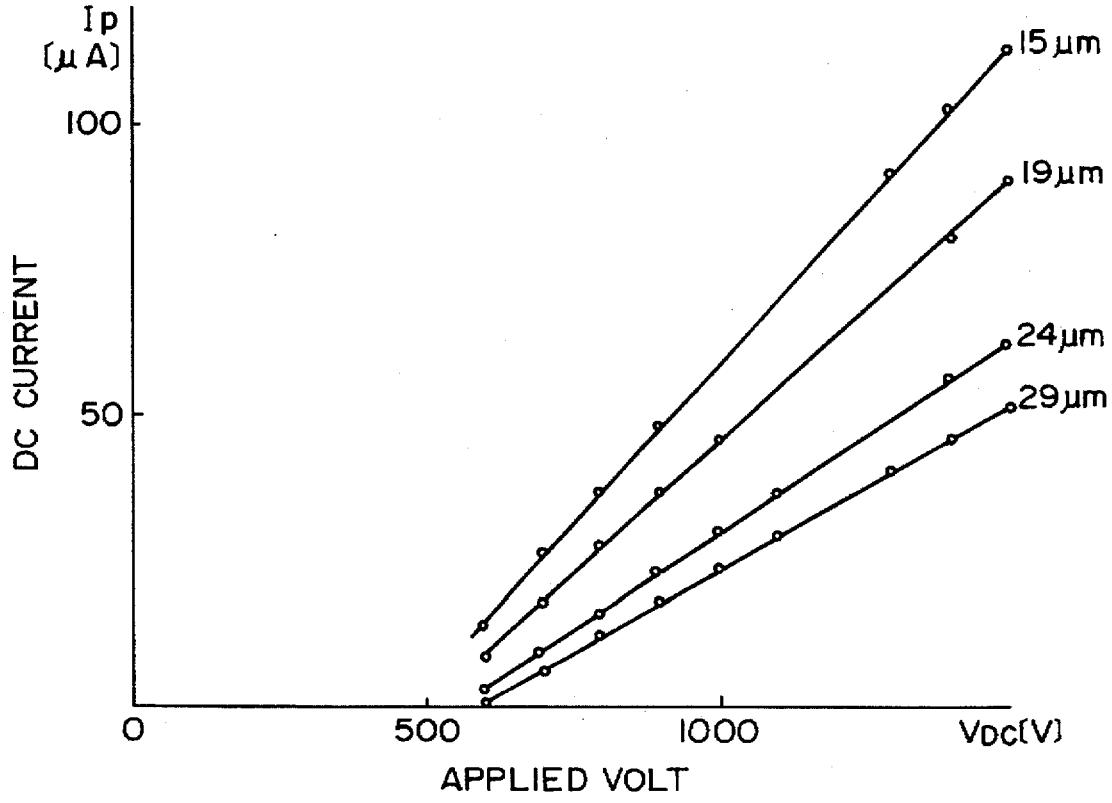

In the present invention, a method for directly detecting the $C_p$ of the photosensitive drum is not adopted. Instead, another method is adopted, in which the voltage to be applied is corrected by simply estimating the $C_p$ of the photosensitive material as shown in FIGS. 7A and 7B showing the charge characteristic change caused by the discharging impedance change, with reference to the film thickness (aforementioned $L_S$) of the charge transferring layer (CT layer) of the photosensitive material of the drum.

FIG. 7A is a graph in which the relations between the voltage applied to the charging roller and the resultant drum surface potential is shown with reference to the film thickness (aforementioned $L_S$) of the CT layer of the drum. In FIG. 7B, the amount of the direct current flowing through the charging roller is shown in correspondence with FIG. 7A. As is evident from these graphs, the charge characteristic, voltage-current characteristic, and charge starting voltage are affected by the thickness of the CT layer of the drum.

Figure 8A:
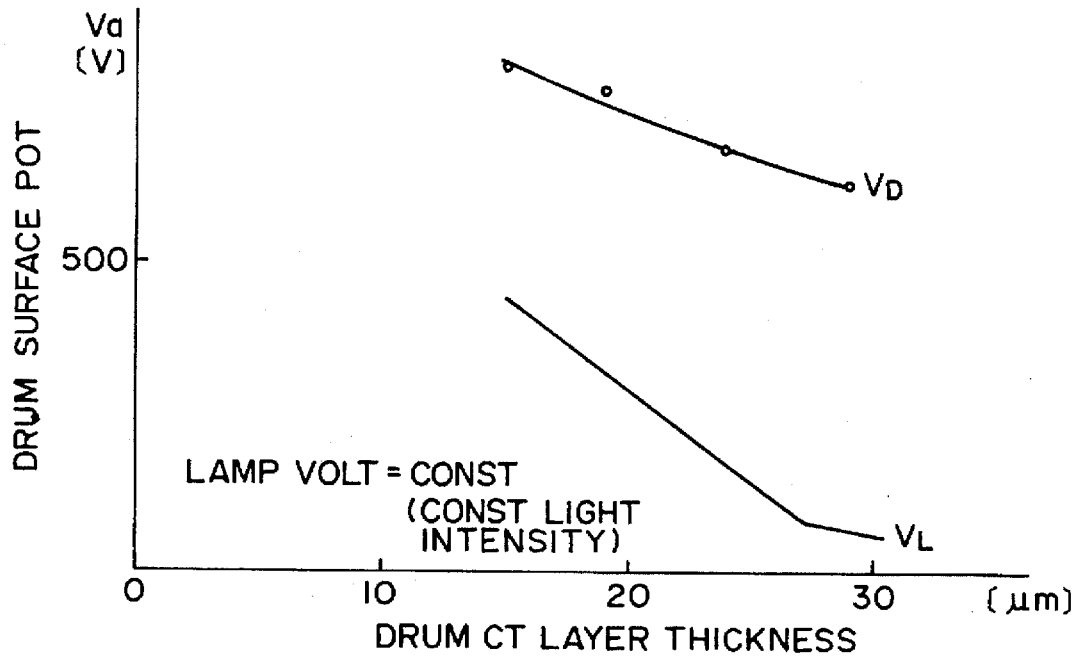
FIGS. 8A and 8B are graphs of the drum surface potential and detected current, respectively, with reference to the CT layer thickness.
Figure 8B:
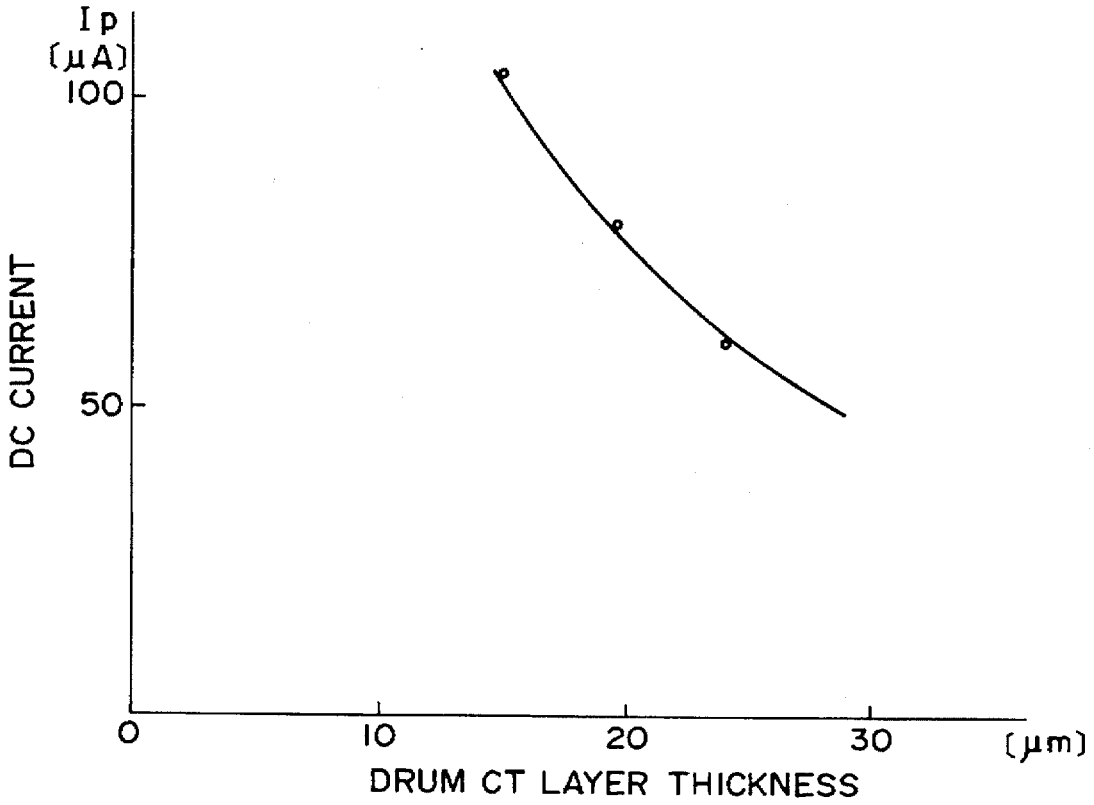

These characteristics are shown in FIGS. 8A and 8B, which show the drum surface potential and the direct current flowing through the charging member, respectively, with reference to the CT layer thickness of the drum, when a constant voltage ($V_{DC}$=1420 V) was applied to the charging member. In FIG. 8A, $V_D$ is a potential corresponding to the dark area, and $V_L$ is a potential corresponding to the light area when a predetermined voltage was applied to the lamp 8 (predetermined amount of light). Here, the relation between the drum surface potential and the direct current can be read with reference to the CT layer thickness. It is evident that the drum surface potential and the amount of the direct current flow increase as the CT layer becomes thinner. In other words, it is evident that a surface potential corresponding to the drum $C_p$ can be estimated by measuring the amount of the direct current flow when a specific constant voltage is applied.

Figure 9:
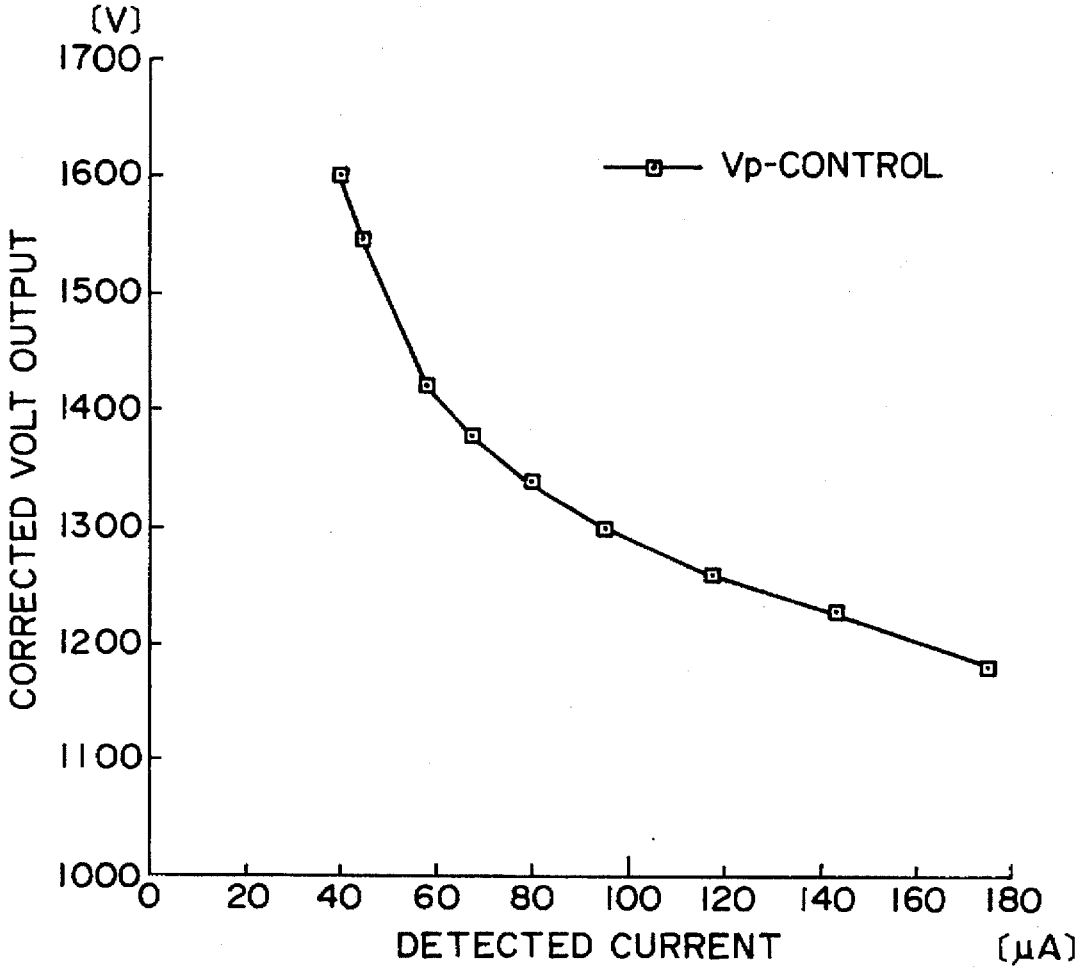
FIG. 9 is a graph of corrected voltage output value, with reference to the detected current.

FIG. 9 is a graph showing the relation between the amount of the detected current (the current flowing through the charging member when the charging member is under the constant voltage control) and the corrected voltage output (voltage output applied to the charging roller under the constant voltage control for the image forming phase) to be applied for keeping constant the drum surface potential regardless of the $C_p$ change which occurs as the thickness of the CT layer of the drum changes. Correction is made to lower the voltage output as the amount of the detected current increases. In addition, a voltage obtained by subtracting 350 V from the voltage selected by referring to this corrected voltage output graph is applied in the non-image forming phase, whereby the potential is kept constant not only in the image forming phase but also in the non-image forming phase, for an extended period of usage. As a result, the effect of the transfer roller cleaning bias can be sustained for the extended period of usage.

Figure 10A:
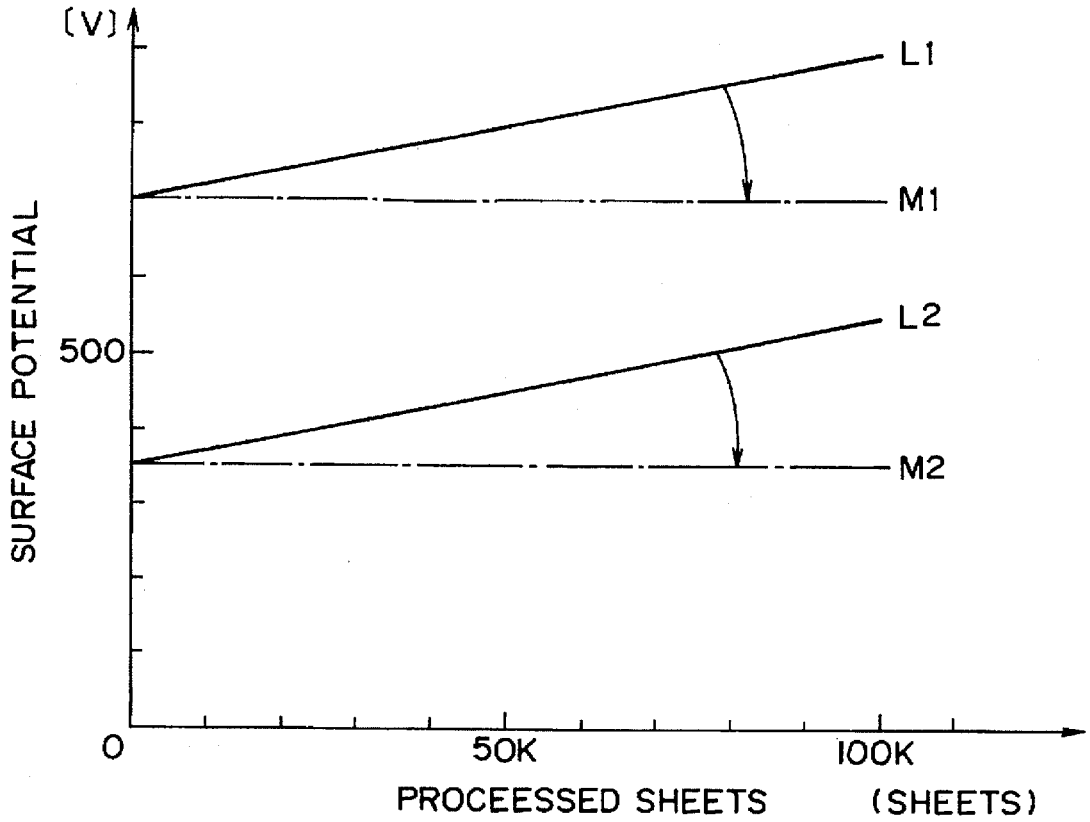
FIGS. 10A and 10B are graphs of the surface potential and CT layer thickness, with reference to the count of processed sheets.
Figure 10B:
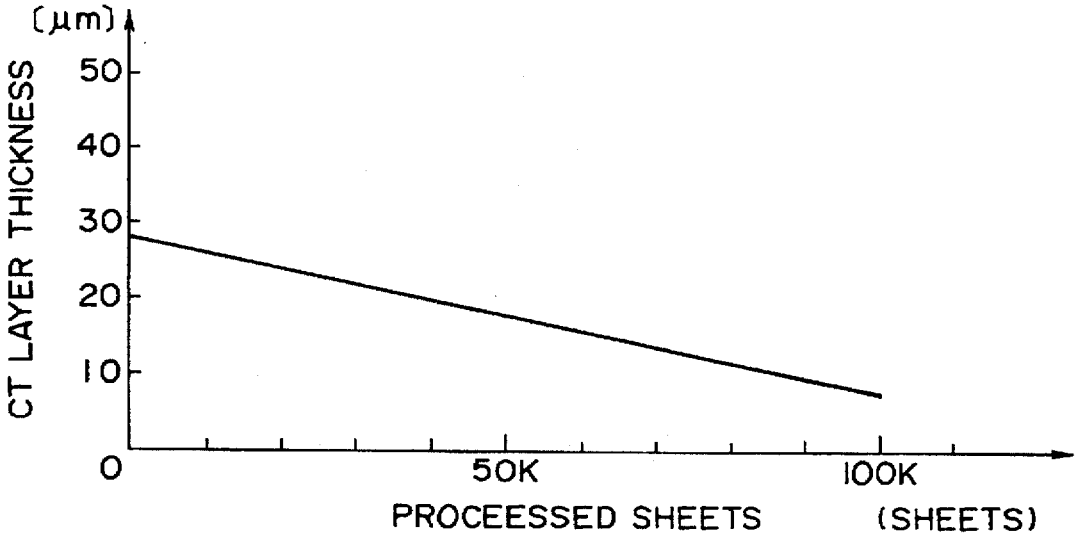

FIGS. 10A and 10B show the results of a test in which the above mentioned correction was made. Sheet count as image formation count (sheet count of the A4 size transfer material; K stands for 1000) is plotted on the abscissa, and the drum surface potential is plotted on the ordinate, showing its change. In FIG. 10A, L1 refers to the surface potential shift corresponding to the image forming phase when a specific constant voltage was applied to the charging roller, and L2 refers to the non-image forming phase. However, when the present invention was applied, in other words, when the amount of the direct current flowing through the charging roller under the constant voltage control was detected, and the voltage to be applied to the charging roller in the image forming phase or non-image forming phase was corrected according to the amount of the detected current, the drum surface potential changed as shown by M1 for the image forming phase or M2 for the nonimage forming phase, in other words, the drum surface potential remained constant in spite of the increased sheet count.

In this test, the above described OPC drum was used. Also, an endurance test was conducted using the image forming apparatus shown in FIG. 1.

As for the charging roller 2, it was constructed as the layer structure model in FIG. 1 shows. First, the metallic core $2_c$ was covered with a conductive rubber layer $2_b$ of EPDM or the like, having a resistance of $10^4$–$10^5$ Ω/cm, which in turn was coated with a resistive layer $2_{a2}$ of hydrin rubber or the like, having an intermediate resistance of $10^7$–$10^9$ Ω/cm, and on top of this layer, a blocking layer $2_{a1}$ of nylon group material such as TORAYGIN (trade mark of Teikoku Kagaku Kabushiki Kaisha), having a resistance of $10^7$–$10^{10}$ Ω/cm was coated as the surface layer. The hardness of the roller was 50°–70° on Asker-c scale. The photosensitive drum 1 was charged by the charging roller 2 placed in contact with the photosensitive drum 1, with a contact pressure of 1600 g, wherein the charging roller 2 was rotated by following the rotation of the photosensitive drum 1.

Further, when the ambient condition of the resistive layer of the charging member changes or a certain change occurs in the charging member due to the extended usage, the resistance increases, which in turn decreases the amount of detected current. In this case, correction is made to increase the voltage to be applied in the image forming phase or non-image forming phase, and therefore, there will be no insufficient charge, offering always a satisfactory image density and image quality.

Figure 11:
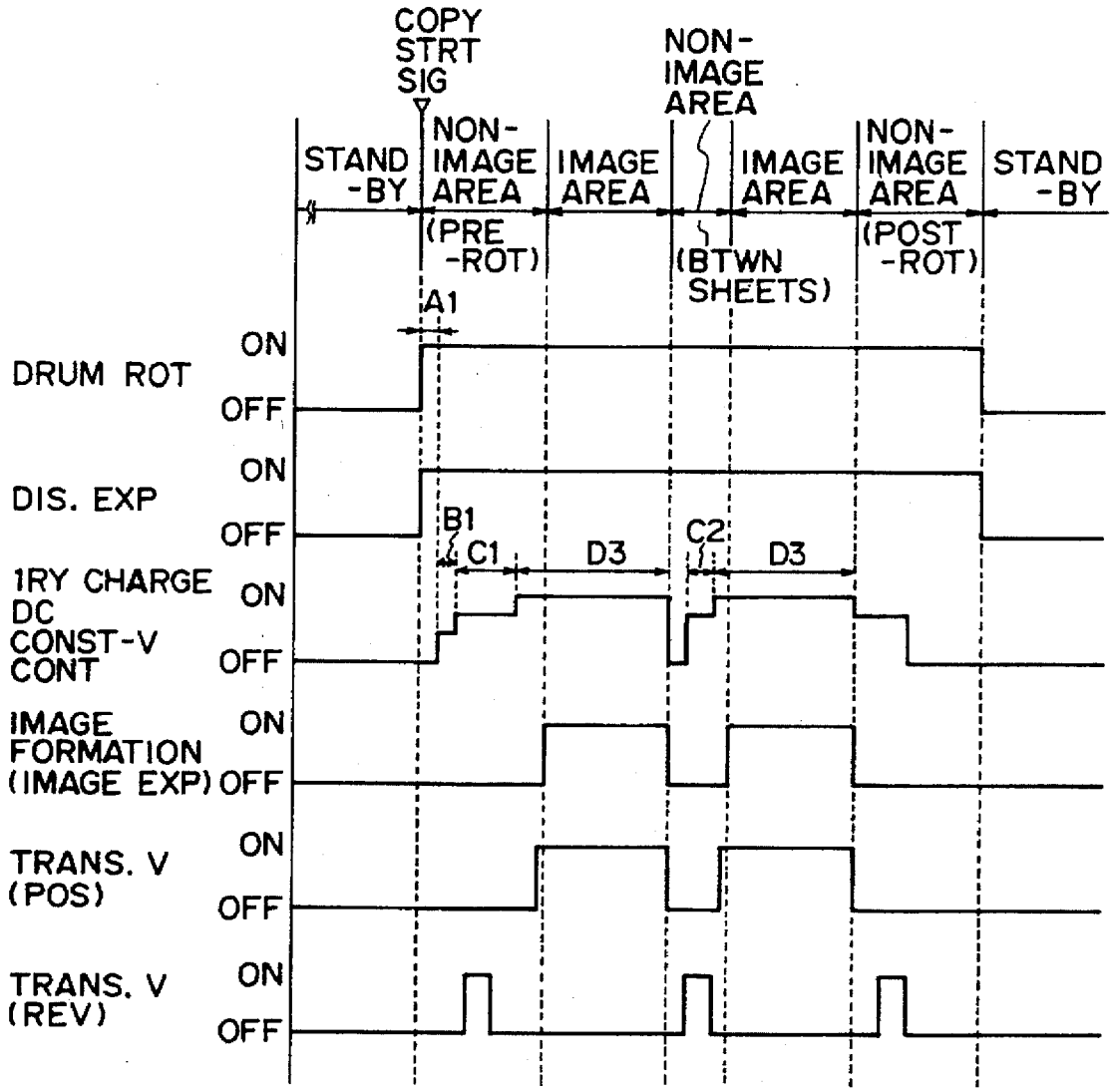
FIG. 11 is an operational sequence for the image forming apparatus.

Next, another example of the operational sequence for this embodiment is shown in FIG. 11. This sequence may replace the one shown in FIG. 3. Compared to the sequence shown in FIG. 3, in this sequence, the constant DC voltage control and DC current detection, which were already described, are carried out only in the segment B1 of the pre-rotation period of the drum 1, and the constant DC voltage control and DC current detection are not carried out during the inter-sheet period.

During a continuous printing operation, the charging roller is constant-voltage controlled in response to the DC current (current flowing through the charging roller) detected in the segment B1, for charging the non-image forming areas (C1, C2) and image forming area (C3).

However, the value of this detected DC current is replaced during the segment B1 of the drum pre-rotation cycle at the beginning of the next printing operation.

Figure 12:
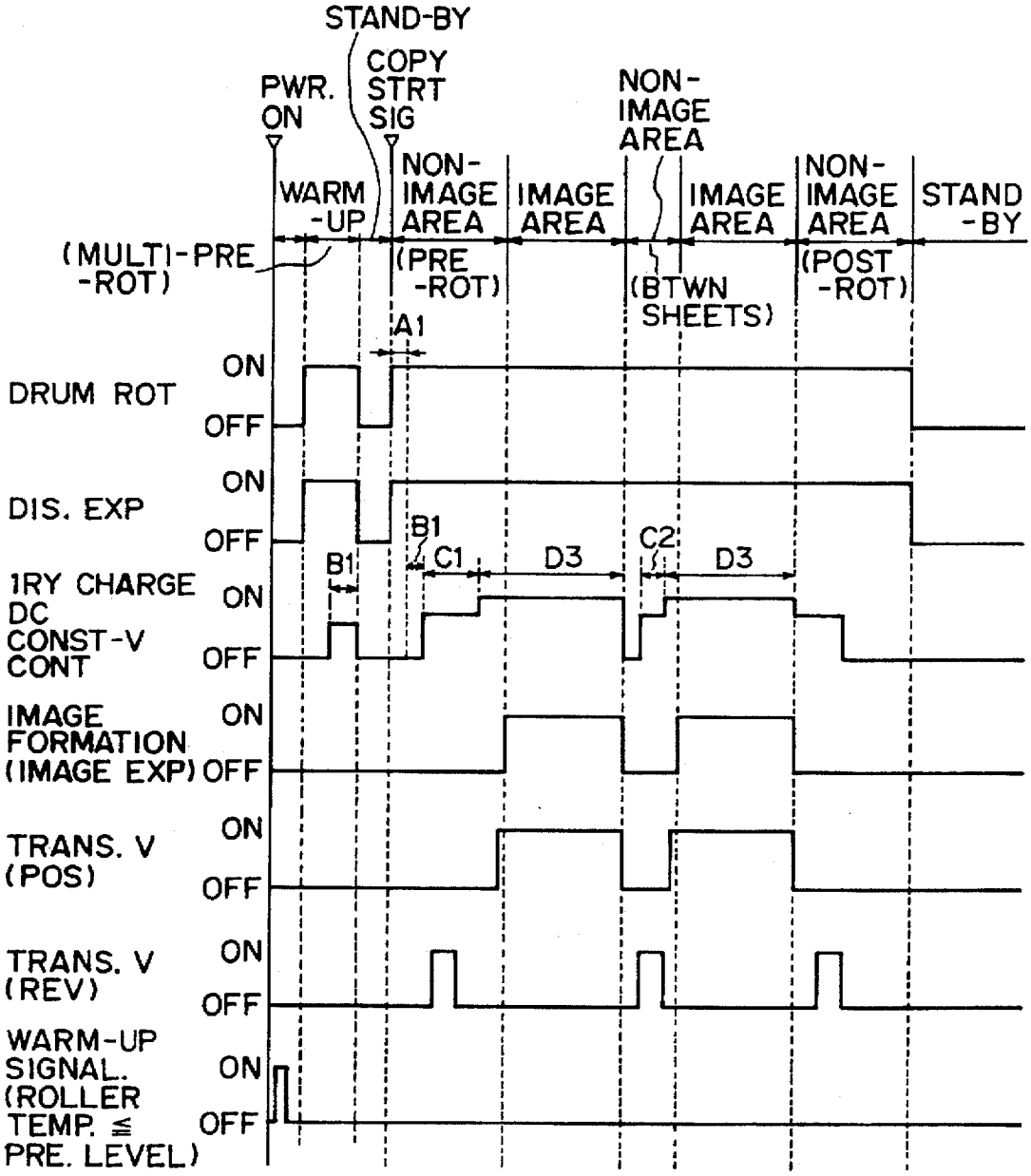
FIG. 12 is an operational sequence for the image forming apparatus.

Referring to FIG. 12, another operational sequence for this embodiment is shown. The sequence in FIG. 12 is carried out when a printer is turned on, wherein the constant DC voltage control of the charging roller 2 and DC current detection are carried out during the segment B1 of the multi-pre-rotation period (warm-up period when the roller temperature of a fixing apparatus is increased, or other preparatory operations are performed).

After completion of the warm-up operation, the power for the drum rotation and charge removing exposure light is turned off, and the apparatus remains on standby until the print starting signal is inputted.

After the print start signal is inputted, the primary charge bias of the charging roller during each of the image forming cycles is constant-DC-voltage controlled using the primary voltage corrected in response to the DC current detected under the constant DC voltage control of the charging roller during the aforementioned multi-pre-rotation period, for charging the image forming area, and also, for charging the area which comes in contact with the transfer roller imparted with the cleaning bias during the non-image forming cycle.

The values of the detected DC current and the corrected primary voltage are retained until the printer is turned off or the temperature of the fixing apparatus drops below a predetermined temperature.

This creates a problem. That is, if the current is to be detected each time the apparatus is turned on, for example, even when the image forming apparatus is turned off for a short time to take care of a paper jam, the current detection is again carried out when the power is turned on the next time, and the voltage to be applied is corrected in response to this freshly detected current. At this time, the accuracy of the current detection is sometimes different between when the power is turned off and when the power is turned on the next time, which produces two different values for the corrected voltage, and therefore, the transfer roller cleaning efficiency becomes unstable. In comparison to the above set up, such a setup as to detect the current substantially once a day, that is, only once at the beginning of the work day schedule (or "first in the morning") is effective for stabilizing the image density. In other words, if the procedure of placing the charging roller under the constant voltage control, detecting the current, and correcting the voltage to be applied is to be carried out only once when the apparatus is started up at the beginning of the work for the day, and the value of this corrected voltage is retained for the entire length of the work day schedule, then the operational efficiency and stability of the apparatus is improved.

As for a means for determining whether or not the apparatus is in the condition of "first in the morning," a certain method has proved to be effective as the results of practical application tests, in which the apparatus is determined to be in the "first in the morning" condition if the detected temperature of the fixing roller in the fixing apparatus is below a specific temperature at the time when the power to the image forming apparatus is turned on. Here, it is effective to choose this specific temperature in a range between 30° C. to 130° C., and in particular, it is most effective if it is selected to be approximately 100° C.

In the above described embodiment, when the drum surface area placed in contact with the charging roller for detecting the photosensitive layer thickness is such an area as to serve as the non-image forming area as the drum rotates, the direct current is detected while the constant direct voltage is applied to the charging roller. However, in such a case as the above, when the drum area is in contact with the charging roller for detecting the photosensitive layer thickness, another method is also acceptable, in which the charging roller is placed under the constant current control using a constant current circuit; a direct voltage induced in the charging roller under the constant current control is detected using a voltage detection circuit connected to the charging roller; and then, the charging roller is placed under the constant DC voltage control using different voltage values depending on whether the drum surface area in contact with the charging roller as described above is going to serve as the image forming area or the non-image forming area as the drum turns. A further method is also acceptable, in which the charging roller is placed under the constant direct current control instead of under the constant DC voltage control corresponding to the thickness of the drum film. In other words, when the drum surface area in contact with the charging roller is going to serve next as the image forming or non-image forming area as the drum rotates, the charging roller is placed under the constant direct current control using a different voltage corresponding to the above mentioned detected current or the detected voltage, depending on the thickness of the drum film.

As described hereinbefore, the thickness of the photosensitive material layer of the drum is gradually reduced while the apparatus is placed in an extended service. This causes the potential of the photosensitive material layer to be smaller compared to when the apparatus is new. Therefore, when the charging member is always placed under the constant current control, the potential of the photosensitive member can be stabilized by increasing the value of the constant current used for the constant current control as the thickness of the photosensitive material layer becomes smaller.

Also, during the operational cycle in which the current flowing through the charging member or the relevant voltage is measured to determine a proper voltage-current relation for the charging member and the photosensitive member, it is more preferable to place the charging member under the constant voltage control than the constant current control. This is because, in the case of the constant current control, if a pin hole is present in the photosensitive layer and this hole comes in contact with the charging roller, almost the entire amount of the current flows through this hole, sometimes causing the power source to break down. Needless to say, it is impossible in this situation to measure precisely the current to determine the voltage for the optimum charge. Also in the case of the constant current control, the range of the voltage to detect is excessively wide, which is liable to increase the cost and size of the apparatus. As it could be understood from the above description that the charging member is preferred to be placed under the constant voltage control, the charging member is preferred to be placed under the constant voltage control not only for determining the appropriate voltage-current relation, but also for charging the photosensitive member to the desired potential, since this will eliminate the need for both the constant current circuit and the constant voltage circuit.

Further, in case the DC current is to be detected only once, if the charging roller 2, that is, the charging member, is not uniform in terms of the resistance in the peripheral direction because of production errors, a problem occurs. That is, when the DC current flowing through the portion having a low resistance is detected, the amount of current is large, which makes small the value of the corrected constant voltage, and in turn, the charge potential is going to be low during the image forming phase and during the non-image forming phase, causing image forming problems, such as the deterioration of the image density in the case of the normal development, and fogg or excessive image density in the case of insufficient cleaning or reversal development.

Figure 13:
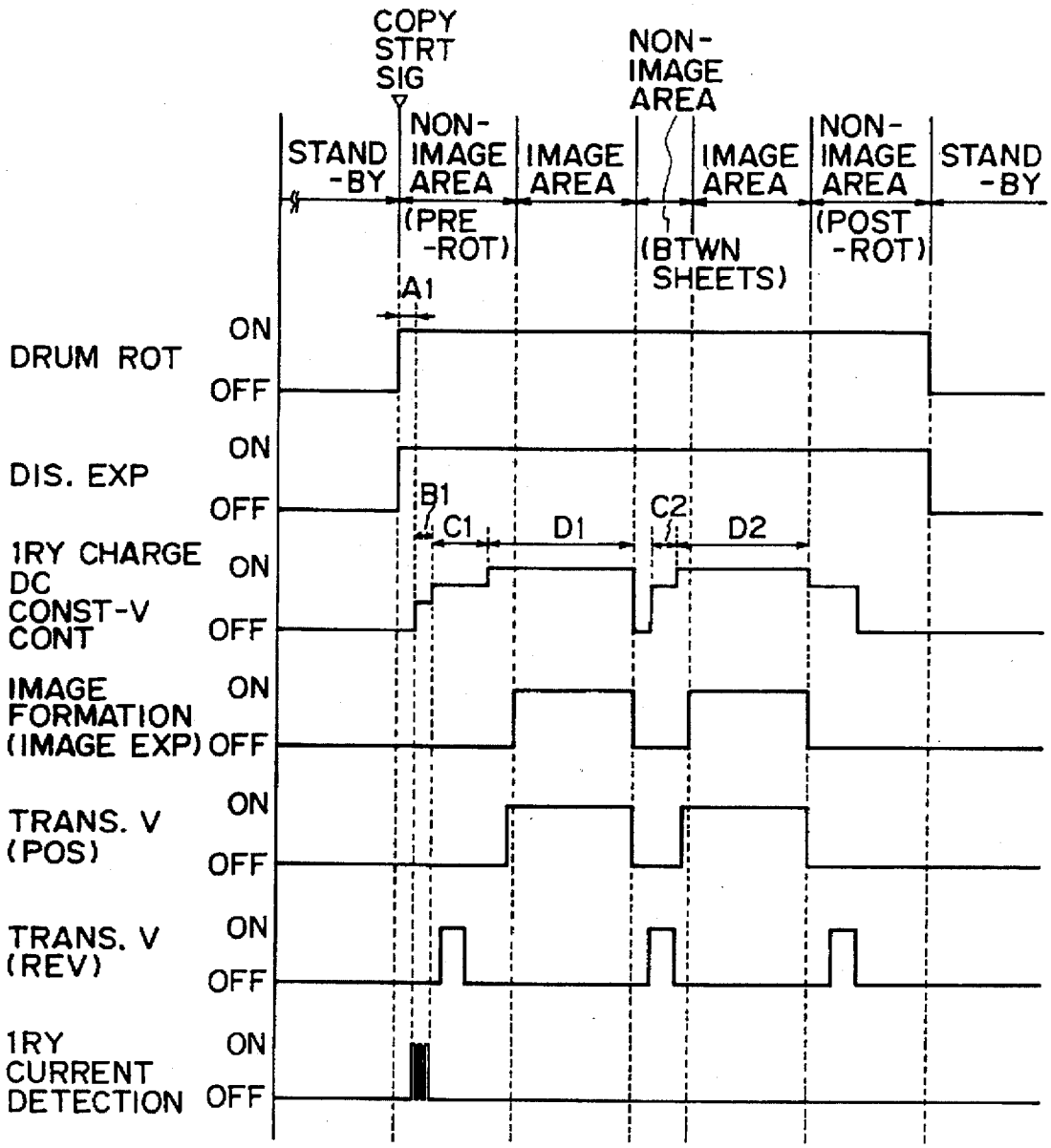
FIG. 13 is an operational sequence for the image forming apparatus.
Figure 14:
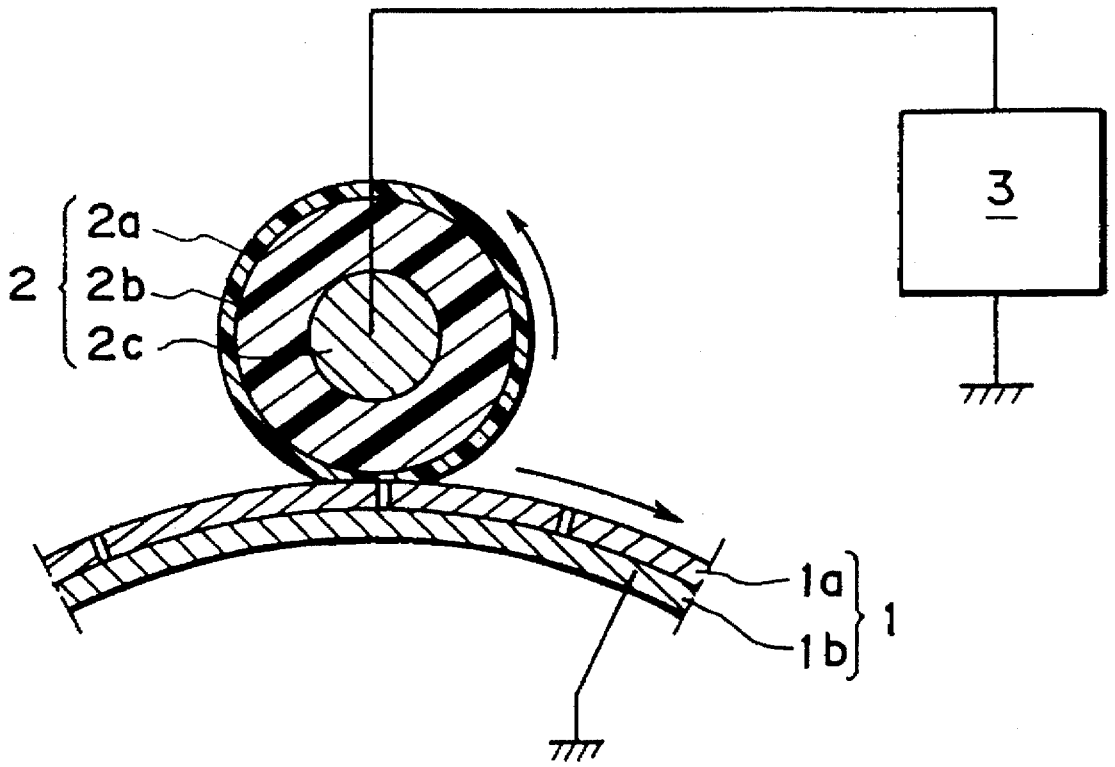
FIG. 14 PRIOR ART
FIG. 14 is a schematic view of a conventional charging apparatus.

In order to solve the problem of image density variance caused by DC current value variance in the rotating direction of the roller, in the case of the operational sequence shown in FIG. 13, the DC current is detected a number of times, and the corresponding number of DC current values are added or integrated to obtain their average. Then, during the image forming operation, the constant voltage control is carried out using the voltage corrected in response to the average value. The DC current detecting timing is preferably spread over no less than one rotational distance of the roller.

In the above method, the maximum and minimum values may be discarded.

By employing the above described method, stable values can be obtained for the detected current, and subsequently, for the corrected voltage in spite of the resistance variance on the charging roller 2 in its rotational direction, and therefore, the image can be always reliably obtained.

What is claimed is:

1. An image forming apparatus comprising:

a movable image bearing member;

image forming means for forming a toner image on said image bearing member;

a charging member for charging said image bearing member in a charging station;

an electrical power source for supplying power to said charging member;

detecting means for detecting a voltage-current characteristic between said charging member and said image bearing member; and control means for controlling the output of said electrical power source, in accordance with an output of said detecting means, when a surface area portion of said image bearing member, where a toner image is not going to be formed as said image bearing member rotates, is in the charging station.

2. An image forming apparatus according to claim 1, wherein said detecting means detects a current flowing through said charging member when said charging member is placed under a first constant voltage control using a first predetermined voltage; and said control means places said charging member under a second constant voltage control using a second predetermined voltage, in accordance with the output, when a surface area portion of said image bearing member, where a toner image is not going to be formed as said image bearing member rotates, is in the charging station.

3. An image forming apparatus according to claim 2, wherein the larger a detected current is than a predetermined value, the smaller said second predetermined voltage is.

4. An image forming apparatus according to claim 1, wherein said detecting means detects a current flowing through said charging member when said charging member is placed under a constant voltage control using a predetermined voltage, and said control means places said charging member under constant current control using a predetermined current, in accordance with the output, when a surface area portion of said image bearing member, where a toner image is not going to be formed as said image bearing member rotates, is in the charging station.

5. An image forming apparatus according to claim 4, wherein the larger the detected current is than a predetermined value, the larger the predetermined current is.

6. An image forming apparatus according to claim 1, wherein said detecting means detects a voltage generated in said charging member when said charging member is placed under a constant current control using a predetermined current, and said control means places said charging member under a constant voltage control using a predetermined voltage, in accordance with the detected voltage, when a surface area portion of said image bearing member, where a toner image is not going to be formed as said image bearing member rotates, is in the charging station.

7. An image forming apparatus according to claim 6, wherein the smaller the detected voltage is than a predetermined value, the smaller the predetermined voltage is.

8. An image forming apparatus according to claim 1, wherein said detecting means detects a voltage generated in said charging member when said charging member is placed under a first constant current control using a first predetermined current; and said control means places said charging member under a second constant current control using a second predetermined current, in accordance with the detected voltage, when a surface area portion of said image bearing member, where a toner image is not going to be formed as said image bearing member rotates, is in the charging station.

9. An image forming apparatus according to claim 8, wherein the smaller the detected voltage is than a predetermined value, the smaller the second predetermined current is.

10. An image forming apparatus according to claim 1, wherein said apparatus comprises transfer means contactable to a back side of a transfer material for transferring a toner image onto the transfer material in a transfer station.

11. An image forming apparatus according to claim 10, wherein said transfer means is imparted with a voltage having the same polarity as the polarity of a toner image during at least a segment of a period when said surface area portion of said image bearing member is in the transfer station.

12. An image forming apparatus according to claim 10, wherein an electric field is formed for transferring a toner from said transfer means to said image bearing member during at least a segment of a period when said surface area portion of said image bearing member is in the transfer station.

13. An image forming apparatus according to claim 1, wherein the output of said electric power source is different when a surface area portion of said image bearing member, where a toner image is not going to be formed as said image bearing member rotates, is in the charging station, and when a surface area portion of said image bearing member, where a toner image is going to be formed as said image bearing member rotates, is in the charging station.

14. An image forming apparatus comprising:

a movable image bearing member;

image forming means for forming a toner image on said image bearing member;

a charging member, contactable to said image bearing member, to charge said image bearing member at a charging station;

an electrical power source for supplying power to said charging member;

a transfer member cooperating with said image bearing member to form a nip therebetween, wherein a toner image formed on said image bearing member is transferrable from said image bearing member onto a transfer material at the nip;

detecting means for detecting a voltage-current characteristic between said charging member and said image bearing member in a first period; and control means for controlling an output of said electrical power source in a second period in which a certain surface area of said image bearing member is in said charging station, in accordance with an output of said detecting means, wherein, when the certain surface area of said image bearing member reaches the nip, an electric field is applied for transferring a toner from said transfer member to the certain surface area of said image bearing member.

15. An image forming apparatus according to claim 14, wherein said detecting means detects a current flowing through said charging member when said charging member is placed under a first constant voltage control using a predetermined first voltage; and said control means places said charging member under a second constant voltage control using a second predetermined voltage, in accordance with the detected current, when the certain surface area is in the charging station.

16. An image forming apparatus according to claim 15, wherein the larger the detected current is than a predetermined value, the smaller said second predetermined voltage is.

17. An image forming apparatus according to claim 14, wherein said detecting means detects a current flowing through said charging member when said charging member is placed under constant voltage control using a predetermined voltage, and said control means places said charging means under constant current control using a predetermined current, in accordance with the detected current, when the certain surface area is in the charging station.

18. An image forming apparatus according to claim 17, wherein the larger the detected current is than a predetermined value, the larger the predetermined current is.

19. An image forming apparatus according to claim 14, wherein said detecting means detects a voltage generated in said charging member when said charging member is placed under constant current control using a predetermined current, and said control means places said charging member under constant voltage control using a predetermined voltage, in accordance with the detected voltage, when the certain surface area is in the charging station.

20. An image forming apparatus according to claim 19, wherein the smaller the detected voltage is than a predetermined value, the smaller the predetermined voltage is.

21. An image forming apparatus according to claim 14, wherein said detecting means detects a voltage generated in said charging member when said charging member is placed under a first constant current control using a first predetermined current, and said control means places said charging member under a second constant current control using a second predetermined current, in accordance with the detected voltage, when the certain surface area is in the charging station.

22. An image forming apparatus according to claim 21, wherein the smaller the detected voltage is than a predetermined value, the larger the second predetermined current is.

23. An image forming apparatus according to any one of claims 14 to 22, wherein a voltage having a polarity the same as a polarity of the toner image during at least a segment of a period when the certain surface area is in the nip is applied to said transfer member.

24. An image forming apparatus according to claim 14, wherein an electric field is formed for transferring a toner from said transfer member to said image bearing member during at least a segment of a period when a surface area portion of said image bearing member is in the transfer nip.

25. An image forming apparatus according to claim 14, wherein an output of said electric power source when the certain surface area is in the charging station is different than when a surface area portion of said image bearing member, where a toner image is going to be formed by said image forming means as said image bearing member rotates, is in the charging station.

26. An apparatus according to claim 14, wherein said image forming means includes said charging member.

* * * * *

UNITED STATES PATENT AND TRADEMARK OFFICE

CERTIFICATE OF CORRECTION

PATENT NO. : 5,701,551
DATED : December 23, 1997
INVENTOR(S) : Honda et al.

It is certified that error appears in the above-identified patent and that said Letters Patent is hereby corrected as shown below:

Item [54] Title
"EN" should read -- AN --.

Column 1
Line 3, "EN" should read -- AN --; and
Line 35, "advantages such" should read -- advantages, in --.

Column 2
Line 15, "the" (second occurrence) should be deleted; and
Line 31, "as" (second occurrence should be deleted.

Column 3
Line 54, "appeared" should read -- appears --.

Column 6
Line 24, "$2_b$" should read -- $2_b$ designates --.

Column 8
Line 8, "above mentioned" should read -- above-mentioned --;
Line 17, "above mentoned" should read -- above-mentioned --; and
Line 51, "$V_D$," should read -- $V_D$. --.

Column 11
Line 12, "above mentioned" should read -- above-mentioned --;
Line 27, "nonimage" should read -- non-image --;
Line 30, above described" should read -- above-described --; and
Line 34, "shows." should read -- as shown. --.

Column 12
Line 43, 'set" should read -- set- --.

UNITED STATES PATENT AND TRADEMARK OFFICE

CERTIFICATE OF CORRECTION

PATENT NO. : 5,701,551
DATED : December 23, 1997
INVENTOR(S) : Honda et al.

It is certified that error appears in the above-identified patent and that said Letters Patent is hereby corrected as shown below:

Column 13
Line 13, "using" should read -- using a --.

Column 14
Line 20, "above described" should read -- above-described --.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*